United States Patent [19]

Wakatake

[11] Patent Number: 4,566,003

[45] Date of Patent: Jan. 21, 1986

[54] DISPLAY ELEMENT AND DISPLAY PANEL USING THE SAME

[76] Inventor: Masayuki Wakatake, No. 405, 9-5 Tamagawa 1-chome, Setagaya-ku, Tokyo, Japan

[21] Appl. No.: 447,096

[22] Filed: Dec. 6, 1982

[30] Foreign Application Priority Data

Dec. 7, 1981 [JP] Japan ..... 56-196646

[51] Int. Cl.[4] ..... G09G 3/16

[52] U.S. Cl. ..... 340/764; 340/783; 40/447

[58] Field of Search ..... 340/783, 815.05, 764, 340/815.29, 815.27, 815.08, 815.09, 763; 40/447, 449, 493, 503, 506

[56] References Cited

U.S. PATENT DOCUMENTS

| | | | |
|---|---|---|---|
| 3,335,512 | 8/1967 | Newman | 340/783 |
| 3,482,344 | 12/1969 | Holloman | 340/764 |
| 4,017,851 | 4/1977 | Felice | 340/815.08 |
| 4,264,906 | 4/1981 | Wakatake | 340/783 |

*Primary Examiner*—Gerald L. Brigance

*Assistant Examiner*—Jeffery A. Brier

*Attorney, Agent, or Firm*—Murray, Whisenhunt & Ferguson

[57] ABSTRACT

A display element is formed by a four-sided right prismatic block member which is rotatable about the axis of its own, has embedded therein first and second magnetic pieces to extend along edges lying on the same diagonal line and has two display surfaces formed by two adjacent ones of four outer peripheral surfaces of the block member.

A display panel comprises a display surface structure, a display switching unit and a drive unit. The display surfaces structure has such display elements sequentially disposed on each line of arrangement at predetermined intervals. The display switching unit has an erasing magnetic head and a writing magnetic head common to the display elements disposed on each line of arrangement. The drive unit has means for moving the display elements and the erasing and writing magnetic heads relative to each other, and means for energizing the writing magnetic head in synchronism with the relative movement of them.

2 Claims, 13 Drawing Figures

DISPLAY ELEMENT AND DISPLAY PANEL USING THE SAME

BACKGROUND OF THE INVENTION

1. Field of the Invention

The present invention relates to a display element which has two display surfaces, for example, of different colors, and magnetic pieces and is rotatable about the axis of its own, and a display panel which has a display surface structure having a number of such display elements arranged to provide a display of a letter, graph, pattern or the like in a predetermined plane.

2. Description of the Prior Art

Heretofore, there has been proposed a display panel of the type producing a display of a desired letter, graph, pattern or the like in two colors by a display surface structure having arranged thereon a number of magnetically rotatable display elements, each having two display surfaces of different colors.

The display element for use in such a display panel is formed by a plate-like member the front and the back side of which form display surfaces of different colors and has a magnetic piece disposed at one of two edges defined by the two display surfaces. For selectively turning such a display element, the display panel has a display switching unit provided with a magnetic head formed by an electromagnet which acts on the magnetic piece of the display element while moving relative thereto.

With the conventional display panel using such display element, however, a display is erased as one magnetic head is moved in one direction (upwardly, for instance,) relative to the display element and then a display is written as the magnetic head is moved in the opposite direction (downwardly, for example). Therefore, the display erasing and writing operation is time-consuming.

Moreover, in the case where the display panel is arranged so that the display element is supported in a manner to be rotatable about a shaft extending in a horizontal direction, and that a magnetic head erases a display and writes a new display while moving up and down relative to the display element, even if the display element is plate-shaped, a shaft receiving hole is bored through the display element to extend along the display surfaces. A small-diametered shaft is loosely inserted into the shaft receiving hole and the display element is suspended from the shaft by the weight of its own. Accordingly, the display element is stably supported so that one of its two display surfaces may lie in a predetermined plane.

When it is desired that the display panel is arranged so that display element is supported rotatably about a shaft extending in a vertical direction and the magnetic head erases a display and writes a new display while moving horizontally relative to the display element, it is difficult to support the display element so that one of its two display surfaces may lie in the predetermined plane.

Besides, when the display element is the plate-shaped member the front and the back side of which form display surfaces, the display element is turned over an angular range of 180 degrees. Therefore, the shaft receiving hole of the display element and the shaft loosely inserted thereinto become worn after long use, resulting in malfunction of the display panel.

SUMMARY OF THE INVENTION

It is therefore an object of the present invention to provide a novel display element and a display panel which are simple in construction but effectively overcome the abovesaid defects of the prior art.

Other objects, features and advantages of the present invention will become more fully apparent from the following description taken in conjunction with the accompanying drawings.

DESCRIPTION OF THE PREFERRED EMBODIMENTS

Figure 1:
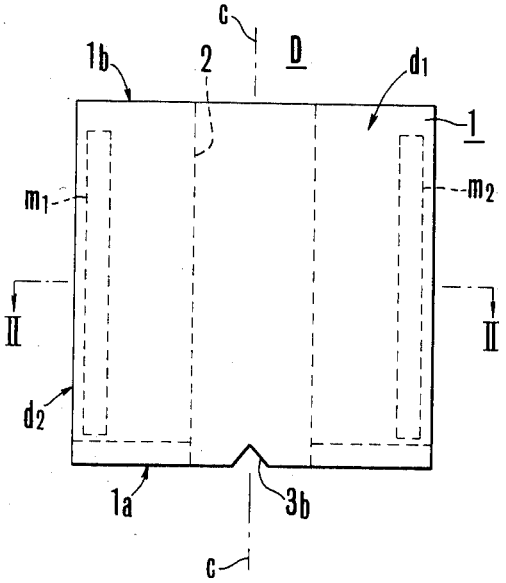
FIGS. 1, 2 and 3 are respectively a front view, a sectional view taken on the line II—II in FIG. 1 and a bottom view, illustrating the construction of an example of the display element of the present invention.
Figure 2:
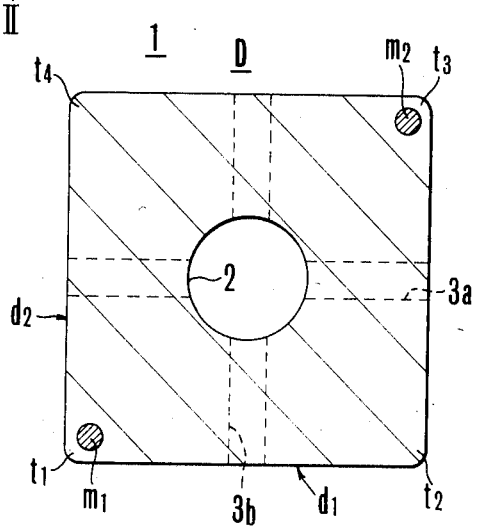
Figure 3:
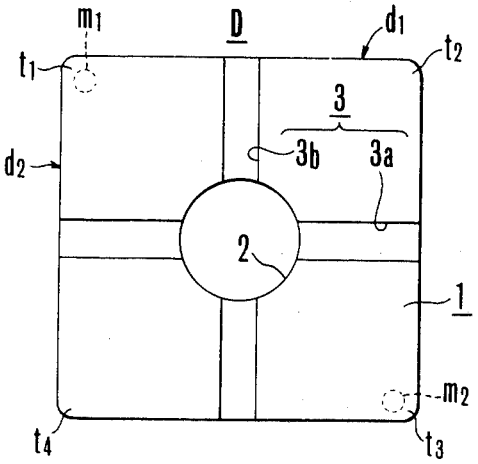

FIGS. 1 through 3 illustrate an example of the display element of the present invention, which element is identified generally by D.

An example of the display element D of the present invention has such a construction as follows:

The display element D is formed by a four-sided right prismatic block member 1 which has four independent outer peripheral surfaces to define four edges $t_1$ to $t_4$ parallel to and around the axis c of the block member 1.

The block member 1 has embedded therein magnetic pieces $m_1$ and $m_2$ which extend in the direction of the axis c along substantially the entire length of the block member 1 at the edges $t_1$ and $t_3$ on the same diagonal line.

The outer peripheral surface of the block member 1 defined between the edge $t_1$ where the magnetic piece $m_1$ is disposed and the adjoining edge $t_2$ forms a first display surface $d_1$. The outer peripheral surface between the edge $t_1$ and the edge $t_4$ diagonally opposite to the edge $t_2$ forms a second display surface $d_2$. The display surfaces $d_1$ and $d_2$ are given different colorings; for example, the display surface $d_1$ is white and the display surface $d_2$ red.

The block member 1 has a centrally disposed shaft receiving hole 2 which is bored therethrough along the axis c.

Furthermore, the bottom 1*a* of the block member 1 has cut therein a cross-shaped groove 3 triangular in cross section and extending across the shaft receiving hole 2. The groove 3 consists of perpendicularly intersecting groove 3a and 3b, which extend in parallel to the display surfaces $d_1$ and $d_2$, respectively.

The above is a description of the construction of an example of the display element of the present invention.

Next, a description will be given of the display panel of the present invention which employs such display elements.

Figure 4:
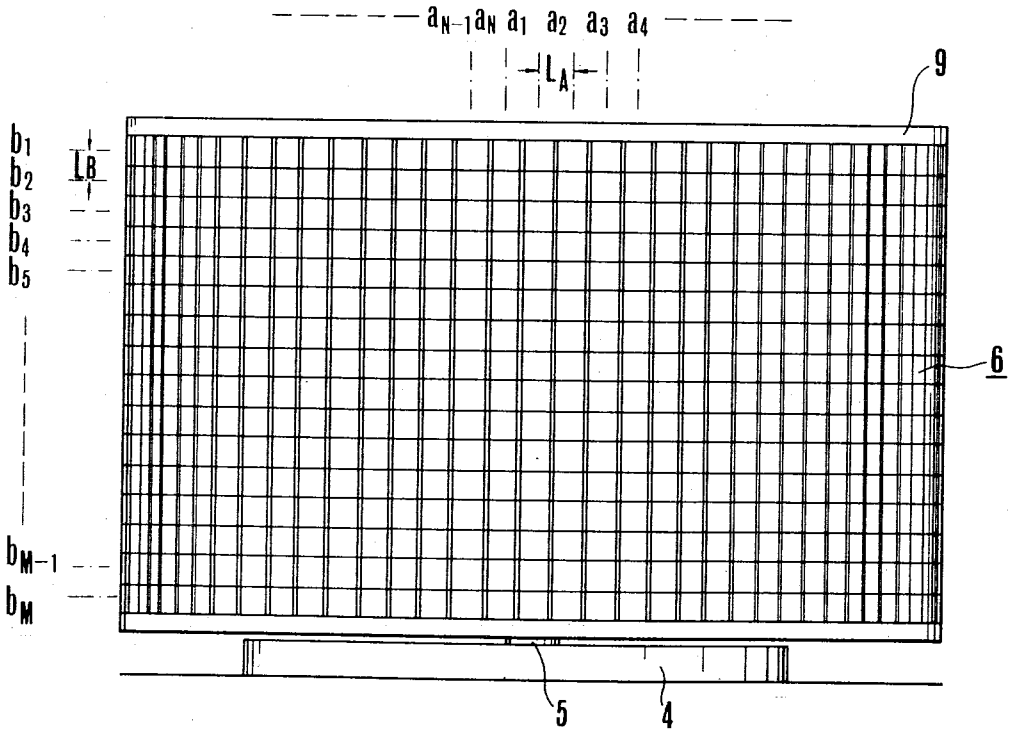
FIGS. 4 and 5 are a front view and a cross-sectional view, schematically illustrating the arrangement of an example of the display panel of the present invention.
Figure 5:
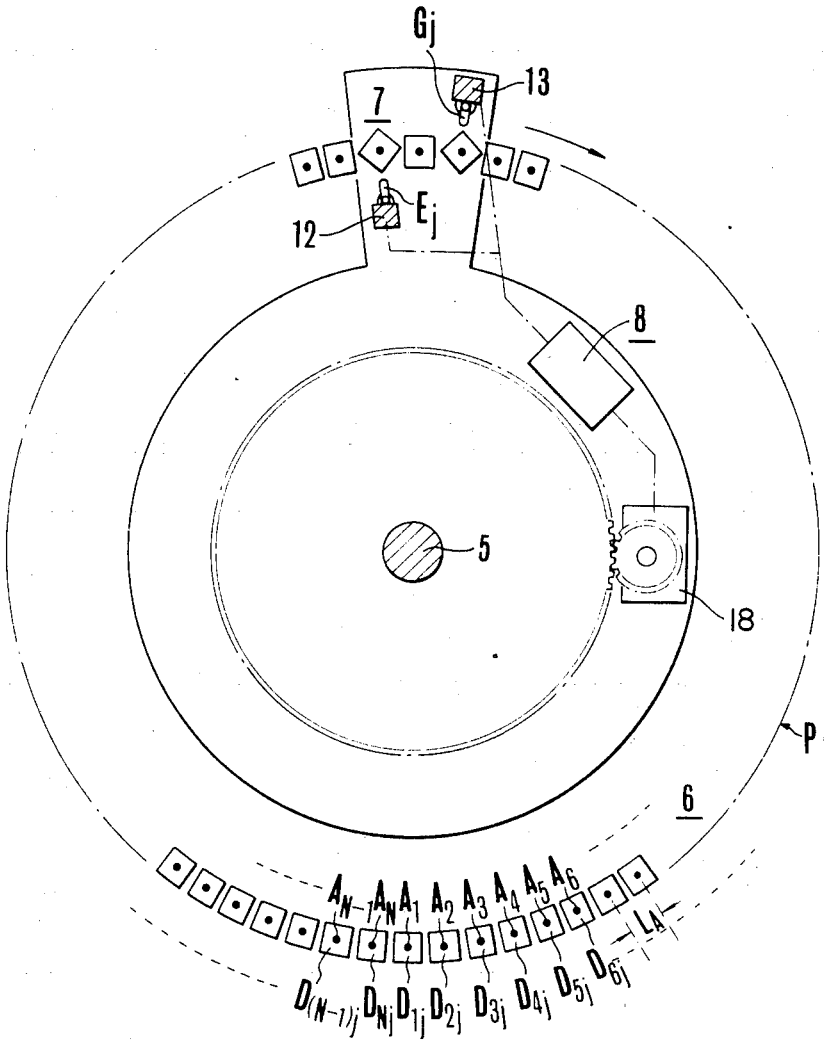

FIGS. 4 and 5 illustrate an example of the display panel employing such display elements as shown in FIGS. 1 to 3.

The display panel comprises a display surface structure 1 rotatable about a shaft 5 planted on a horizontal base plate 4, a display switching unit 7 mounted on the base plate 4, and a drive unit 8 for turning the display surface structure 6 and activating the display switching unit 7.

The display surface structure 6 has a disc-shaped support plate 9 rotatably mounted on the top of the shaft 5.

Moreover, the display surface structure 6 has N shafts $A_1$ to $A_N$ which extend vertically from the marginal edge of the support plate 9 along vertical lines of arrangement $a_1$ to $a_N$ spaced a predetermined distance $L_A$ apart in the circumferential direction of the support plate 9.

Besides, the display surface structure 6 has M support rods $B_1$ to $B_M$ which extend in a circular form along the circumferential direction of the support plate 9 (in the horizontal direction) at predetermined intervals $L_B$ in the direction of extension of the shafts $A_1$ to $A_N$ (in the vertical direction).

The shafts $A_1$ to $A_N$ are respectively coupled with the support rods $B_1$ to $B_M$.

Figure 6:
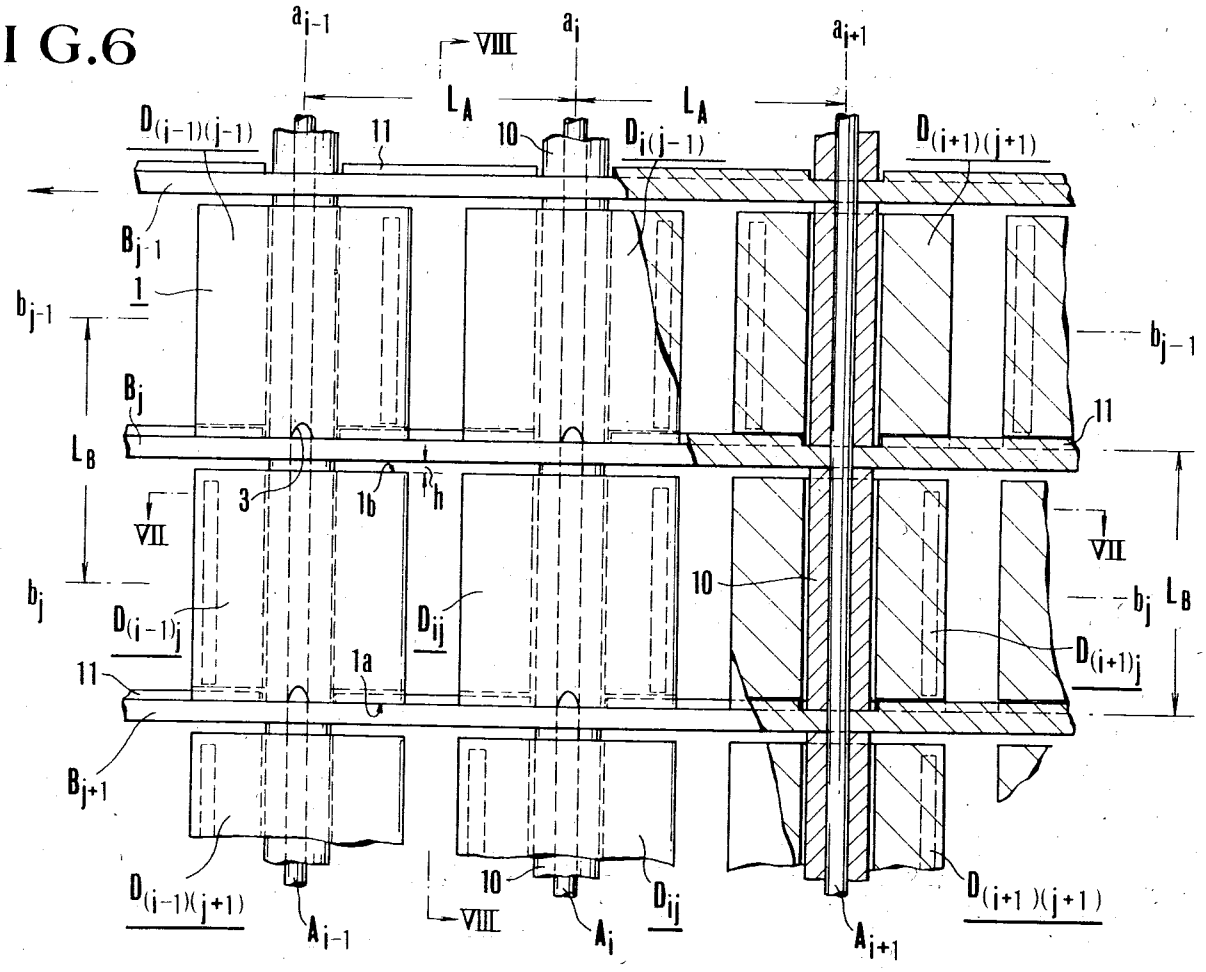
FIGS. 6, 7 and 8 are respectively a front view, a sectional view taken on the line VII—VII in FIG. 6 and a sectional view taken on the line VIII—VIII in FIG. 6, illustrating a portion of a display surface structure for use in the display panel of the present invention.
Figure 7:
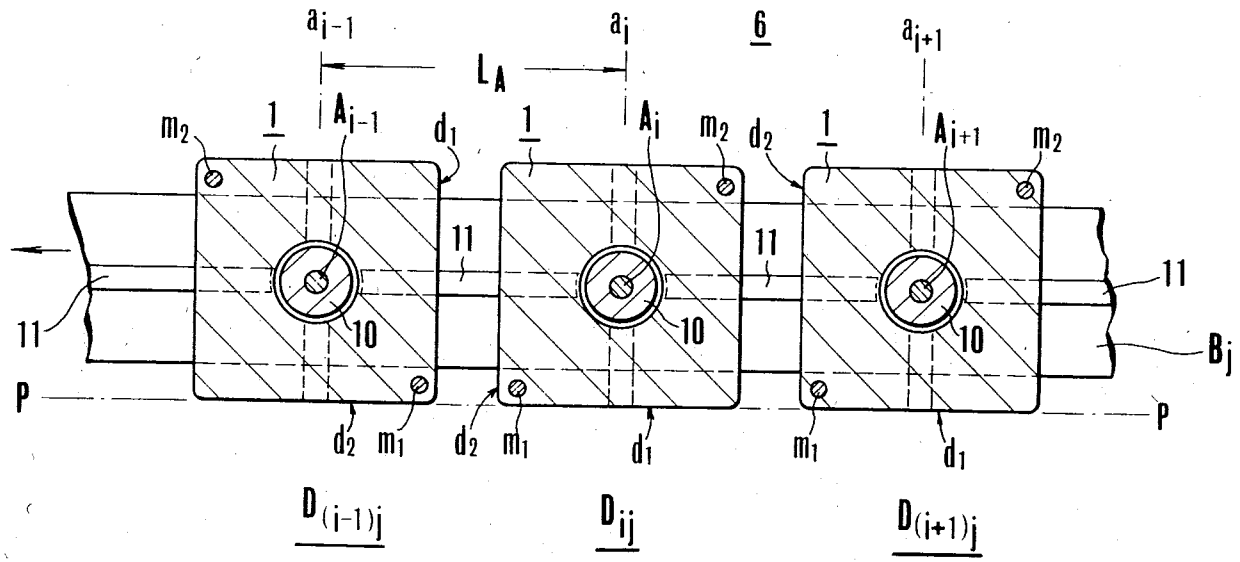
Figure 8:
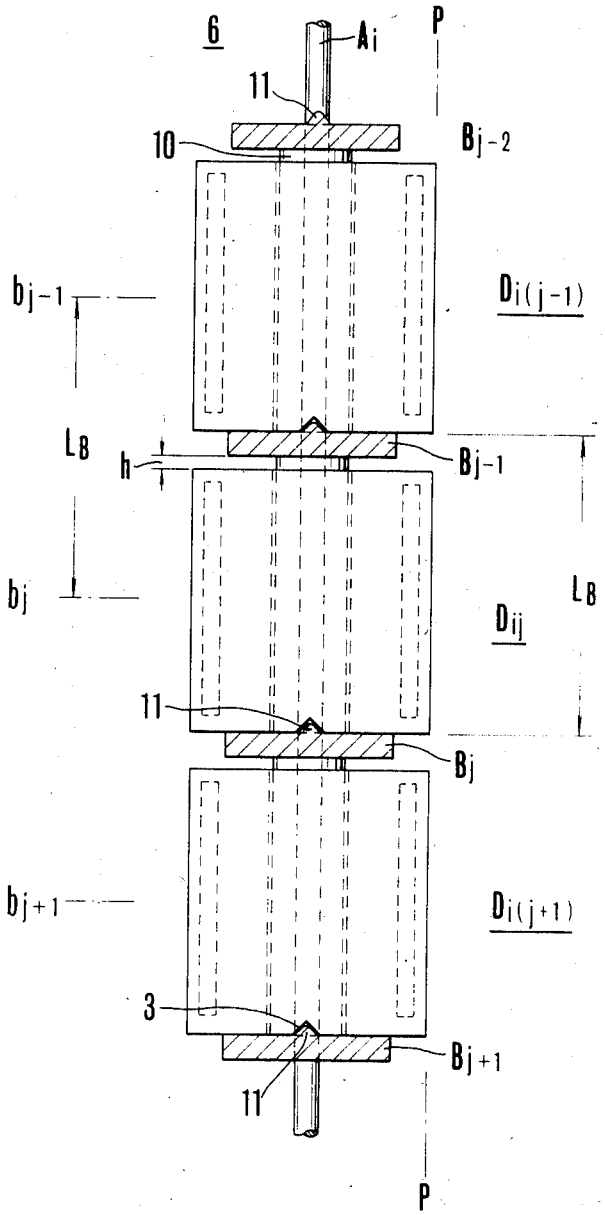

As shown in FIGS. 6 to 8, the shafts $A_1$ to $A_N$ are each loosely inserted into the shaft receiving holes 2 of the display elements D, each formed by the block member 1 depicted in FIGS. 1 to 3; the display elements D are rotatably mounted on the shafts $A_1$ to $A_N$ and rest on the support rods $B_1$ to $B_M$, respectively.

Accordingly, the display surface structure 6 has a total of $N \times M$ display elements D.

Furthermore, letting lines of arrangement extending in a direction perpendicular to the direction of extension of the shafts $A_1$ to $A_N$, that is, in the direction parallel to the horizontal rods $B_1$ to $B_M$ (in the horizontal direction) and spaced the predetermined distance $L_B$ apart in the direction of extension of the shafts $A_1$ to $A_N$ (in the vertical direction) be represented by $b_1$ to $b_M$, respectively, the display surface structure 6 has N display elements $D_{1j}$ to $D_{Nj}$ disposed on the line of arrangement $b_j$ ($j=1, 2, \ldots M$) at the predetermined intervals $L_A$.

In FIGS. 6 to 8, the support rods $B_1$ to $B_M$ are shown to extend on straight lines. As is evident from FIGS. 6 to 8, the display element $D_{ij}$ is mounted on the shaft $A_i$ through a sleeve 10 in a manner to be rotatable thereabout and slightly slidable thereon in its axial direction. The display element $D_{ij}$ is supported with its bottom 1a resting on the support rod $B_j$.

On the top surface of the support rod $B_j$ is formed a flange 11 extending in the direction of extension of the support rod $B_j$ for engagement with either one of the grooves 3a and 3b out in the bottom 1a of the block member 1.

Accordingly, the display element $D_{ij}$ is supported by the support rod $B_j$ so that either one of the display surfaces $d_1$ and $d_2$ may lie in a predetermined plane P.

The spacing of the support rods $B_{(j-1)}$ and $B_j$ is defined by the sleeve 10 so that the distance between the top surface 1b of the block member 1 forming the display element $D_{ij}$ mounted on the shaft $A_i$ through the sleeve 10 while resting on the support rod $B_j$ and the bottom of the support rod $B_{(j-1)}$ above the display element $D_{ij}$ may be a little larger than the height h of the flange 11 from the top surface of the support rod $B_j$.

Consequently, when it is rotated, the display element $D_{ij}$ is able to slightly slide up crossing over the flange 11.

Figure 9:
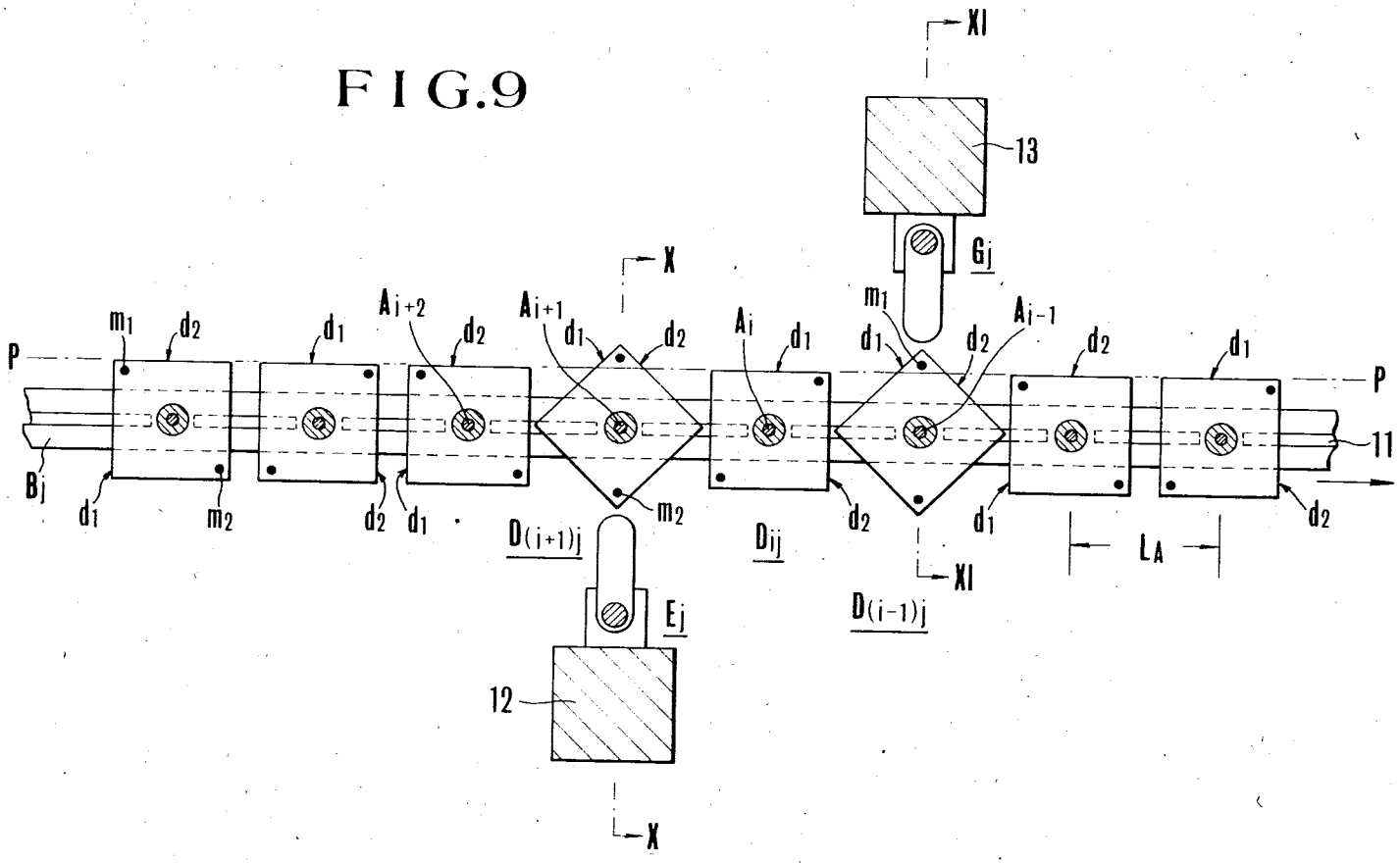
FIGS. 9, 10 and 11 are respectively a cross-sectional view, a sectional view taken on the line X—X in FIG. 9 and a sectional view taken on the line XI—XI in FIG. 9, illustrating a portion of the display panel of the present invention.
Figure 10:
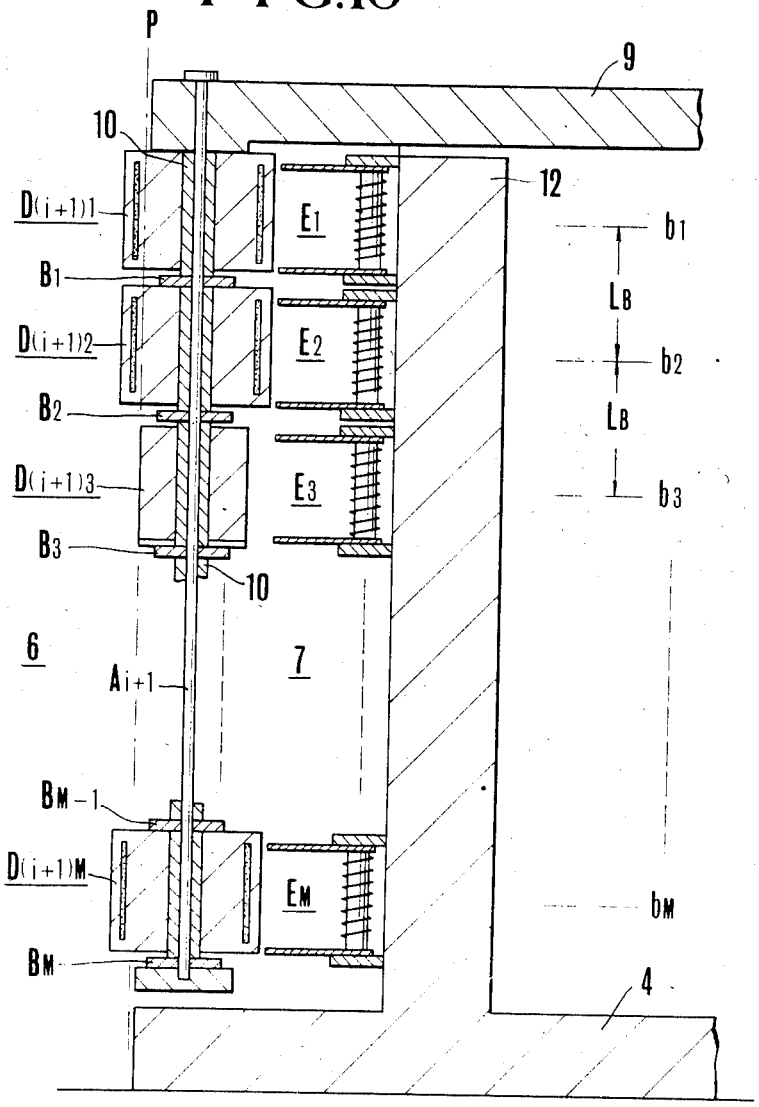
Figure 11:
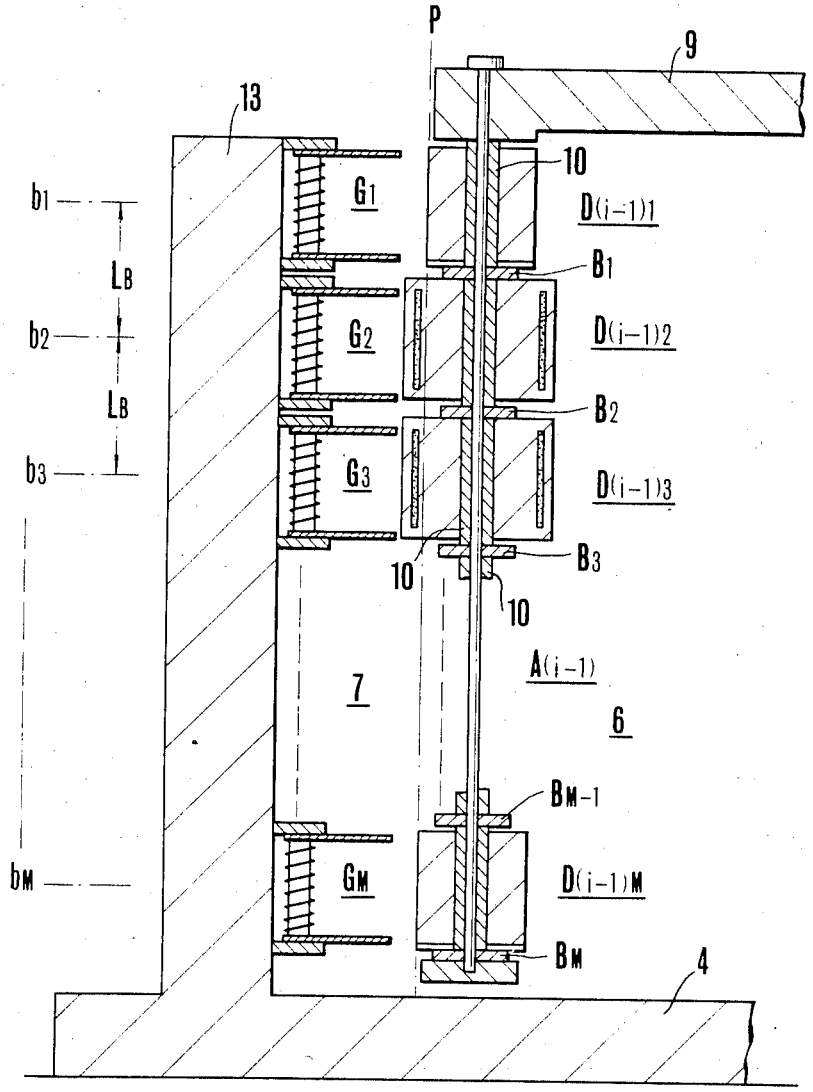

The display switching unit 7 has, on the sides of either one and the other of the front and the back of the plane of arrangement of the display elements $D_{1j}$ to $D_{Nj}$, an erasing magnetic head $E_j$ and a writing magnetic head $G_j$ common to the display elements $D_{1j}$ to $D_{Nj}$ disposed on the line of arrangement $b_j$ as shown in FIGS. 9 to 11.

The erasing magnetic heads $E_1$ to $E_M$ and the writing magnetic heads $G_1$ to $G_M$ are mounted on side surfaces of support posts 12 and 13 planted on the horizontal base plate 4 so that they may face towards the plane of arrangement of the display elements.

The support posts 12 and 13 are planted on the horizontal base plate 4 in such a manner that they stand on opposite sides of the plane of arrangement of the display elements and are deviated from each other in the direction of movement of the display surface structure 6.

On the support post 12 are mounted the erasing magnetic heads $E_1$ to $E_M$ sequentially at the positions respectively corresponding to the lines of arrangement $b_1$ to $b_M$.

Similarly, the writing magnetic heads $G_1$ to $G_M$ are mounted on the support post 13 at the positions respectively corresponding to the lines of arrangements $b_1$ to $b_M$.

Figure 12:
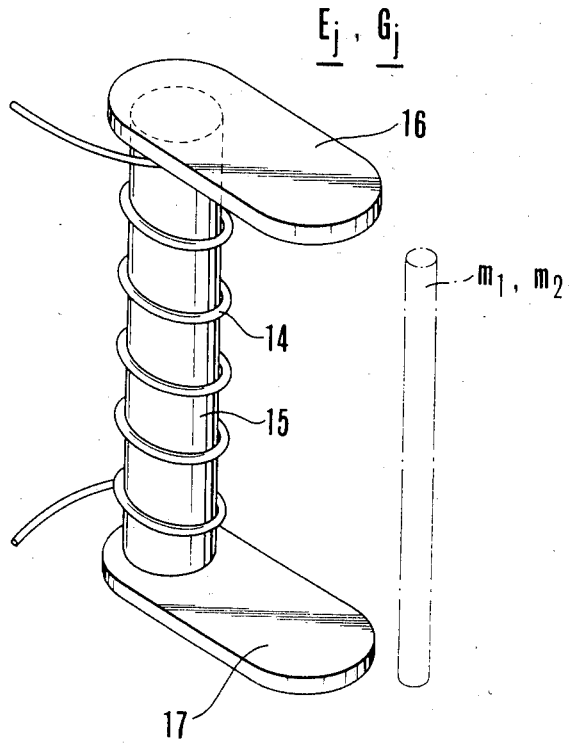
FIG. 12 is a perspective view showing a magnetic head for use in the present invention.

The erasing magnetic head $E_j$ and the writing magnetic head $G_j$ are each provided with a columnar magnetic core 15 having wound thereon a coil 14 and a pair of magnetic plates 16 and 17 attached to the opposite ends of the magnetic core 15 to extend perpendicularly to its lengthwise direction as shown in FIG. 12.

The distance between the magnetic plates 16 and 17 is substantially equal to the lengths of the magnetic pieces $m_1$ and $m_2$ of the display element $D_{ij}$.

The magnetic heads $E_j$ and $G_j$ are respectively mounted on the support posts 12 and 13, with the magnetic core 15 held in the vertical direction and the magnetic plates 16 and 17 extending towards the dsiplay element array of the display surface structure 6. Consequently, the top end portions of the magnetic plates 16 and 17 of the magnetic heads $E_j$ and $G_j$ approach the display elements $D_{1j}$ to $D_{Nj}$ one after another as the display surface structure 6 rotates.

Also in FIG. 9, the support rod $B_j$ is shown to extend linearly.

The drive unit 8 has mechanical drive means including, for instance, a motor 18, for shifting the display elements $D_{1l}$ to $D_{NM}$ of the display surface structure 6 relative to the erasing magnetic heads $E_1$ to $E_M$ and the writing magnetic heads $G_1$ to $G_M$. Since this mechanical drive means is not directly related to the subject matter of the present invention, no detailed description will be given of its arrangement.

Furthermore, the drive means 8 has electrical drive means for energizing the erasing magnetic heads $E_1$ to $E_M$ at all times and activating the writing magnetic heads $G_1$ to $G_M$ in synchronism with the movement of the display elements $D_{1l}$ to $D_{NM}$. Since this electrical drive means is not directly related to the subject matter of the present invention, either, no detailed description will be given of its arrangement.

The above is a description of the display element of the present invention and the arrangement of an embodiment of the display panel using such display elements.

Figure 13:
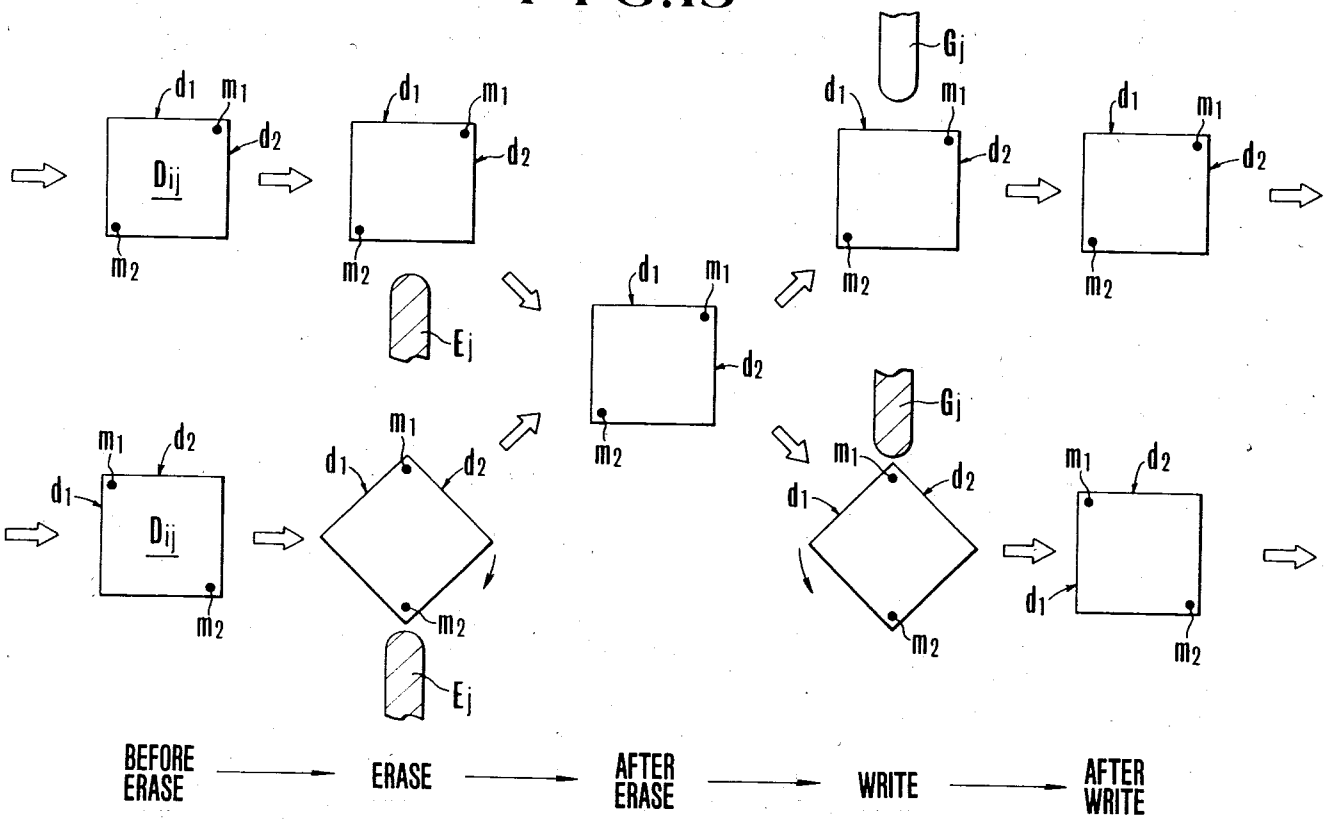
FIG. 13 is explanatory of a display erase and a display write operation of the display panel of the present invention.

Referring next to FIG. 13, the operation of the present invention will be described.

FIG. 13 shows the state in which the display element $D_{ij}$ is turned by the erasing magnetic head $E_j$ and the writing magnetic head $G_j$ during its movement.

The erasing magnetic head $E_j$ is always energized but the writing magnetic head $G_j$ is selectively energized in synchronism with the movement of the display element $D_{ij}$ in accordance with a preset program. In FIG. 13, energized magnetic heads $E_j$ and $G_j$ are indicated by hatching.

First, in the case where the display element $D_{ij}$ has its display surface $d_1$ lying in the predetermined plane P before erasing a display, even if the magnetic piece $m_2$ of the display element $D_{ij}$ is subjected to the action of the erasing magnetic head $E_j$ when the display element $D_{ij}$ passes by the head $E_j$, the display element $D_{ij}$ is not turned. In practice, the display element $D_{ij}$ is slightly turned counterclockwise but it is immediately turned clockwise to return to its initial state. Accordingly, the display surface $d_1$ is held in the predetermined plane P.

Next, in the case where the display element $D_{ij}$ has its display surface $d_2$ lying in the predetermined plane P before erasing a display, the magnetic piece $m_2$ is subjected to the action of the erasing magnetic head $E_j$ and, consequently, the display element $D_{ij}$ is turned 90 degrees in the clockwise direction, bringing the display surface $d_1$ to the predetermined plane.

As described above, the display element $D_{ij}$, after having moved across the erasing magnetic head $E_j$, has its display surface $d_1$ lying in the predetermined plane P. Thus the display erasing operation is completed.

In the case where the display element $D_{ij}$ having its display thus erased moves across the writing magnetic head $G_j$, if the magnetic head $G_j$ is not being energized, the display element $D_{ij}$ is held with its display surface $d_1$ lying in the predetermined plane P. In the event that the writing magnetic head $G_j$ is being energized, the magnetic piece $m_1$ of the display element $D_{ij}$ is subjected to the action of the magnetic head $G_j$ and the display element $D_{ij}$ is turned 90 degrees counterclockwise, bringing its display surface $d_2$ to the predetermined plane P.

With such an arrangement as described above, the display surfaces $d_1$ of the display elements $D_{1l}$ to $D_{NM}$ can be brought to the predetermined plane P by the erasing magnetic heads $E_1$ to $E_M$.

Further, a selected one of the display surfaces $d_1$ and $d_2$ of a desired one or ones of the display elements $D_{1l}$ to $D_{NM}$ can be made to lie in the predetermined plane P after such display erasing operation.

Accordingly, if the display surfaces $d_1$ and $d_2$ are colored, for example, white and red, respectively, it is possible to provide a desired display of a letter, symbol, graph, pattern or the like in red on a white ground.

In addition, since the display element $D_{ij}$ is formed by the four-sided right prismatic block member 1, it can easily be held with either one of the display surfaces $d_1$ and $d_2$ lying in the predetermined plane P even when the display panel is designed so that the display surface structure 6 moves in the horizontal direction.

Moreover, the four-sided right prismatic block member 1 forming the display element $D_{ij}$ has the outer peripheral surfaces formed to define the four edges $t_1$ to $t_4$ in parallel to and around the axis c of the block member 1 and the magnetic pieces $m_1$ and $m_2$ disposed to extend along the edges $t_1$ and $t_3$, and the outer peripheral surfaces defined by the edges $t_1$ and $t_2$ and the edges $t_1$ and $t_4$ constitute the first and second display surfaces $d_1$ and $d_2$, respectively. The display element $D_{ij}$ is supported so that these display surfaces are rotatable about the axis c of the block member 1. Besides, the display switching unit 7 has the erasing magnetic head $E_j$ and the writing magnetic head $G_j$ common to the display elements $D_{1j}$ to $D_{Nj}$ arranged on the line of arrangement $b_j$, the magnetic heads $E_j$ and $G_j$ being disposed on the sides of either one and the other of the front and the back of the plane of arrangement of the display elements $D_{1j}$ to $D_{Nj}$. With this arrangement, a display can be erased and written by the movement of the display elements $D_{1l}$ to $D_{NM}$ in one direction, providing an excellent function of the display panel.

Furthermore, since the angle of rotation of the display element $D_{ij}$ when erasing and writing a display is 90 degrees, wear of the display element $D_{ij}$ and the shafts $A_1$ to $A_N$ is little.

While in the foregoing embodiment the erasing head $E_j$ is described to have the same electromagnet structure as does the writing magnetic head $G_j$, it is also possible to employ a permanent magnet structure for the erasing magnetic head $E_j$. In such a case, power consumption can be reduced.

Although in the foregoing embodiment the magnetic heads $E_j$ and $G_j$ are fixed and the display elements $D_{1l}$ to $D_{NM}$ of the display surface structure 6 are movable, it is also possible to fix the display surface structure and move the magnetic heads.

It will be apparent that many modifications and variations may be effected without departing from the scope of the novel concepts of the present invention.

What is claimed is:

1. A display element which is formed by a four-sided right prismatic block member having an axis and a top and a bottom and having four outer peripheral surfaces formed to define first, second, third and fourth edges in parallel to and around said axis of the block member, said block member being rotatable about said axis, said block member having a shaft receiving hole therethrough along said axis; said block member further consisting of first and second magnetic pieces disposed to extend along said first and third edges, respectively, first and second display surfaces defined by the outer peripheral surfaces between said first and second edges and said first and fourth edges, respectively, and first and second grooves formed in the bottom of said block member, each of said grooves intersecting said axis, said first and second grooves parallel to said first and second display surfaces, respectively.

2. A display panel comprising:

a movable display surface structure;

a display switching unit; and a drive unit;

wherein, letting M lines of arrangement spaced a predetermined distance apart in a first direction and arranged to extend in a second direction perpendicular to the first direction to be represented by $b_1$, $b_2$, . . . $b_M$ respectively, the display surface structure has N display elements $D_{1j}$ to $D_{Nj}$ sequentially disposed on the line of arrangement $b_j$ (j=1, 2, . . . M) at predetermined intervals in the second direction, said first and second directions defining a plane of arrangement having a front side and a back side;

wherein the display element $D_{ij}$ (i=1, 2, . . . N) is formed by a four-sided right prismatic block member having an axis and a top and a bottom and having four outer peripheral surfaces formed to define first, second, third and fourth edges in parallel to and around said axis of the block member, said block member being rotatable about said axis, said block member having a shaft receiving hole therethrough along said axis; said block member further consisting of first and second magnetic pieces disposed to extend along said first and third edges, respectively, first and second display surfaces defined by the outer peripheral surfaces between said first and second edges and said first and fourth edges, respectively, and first and second grooves formed in the bottom of said block member, each of said grooves intersecting said axis, said first and second grooves parallel to said said first and second display surfaces, respectively;

wherein said display surface structure includes N shafts $A_i$ extending in said first direction and spaced apart in said second direction, each of said display elements $D_{ij}$ slidingly receiving a corresponding shaft $A_i$ in said shaft receiving hole to be rotatable thereabout and slidable in the axial direction relative to said shaft $A_i$;

wherein said display surface structure further includes M support rods $B_j$ extending in said second direction and spaced apart in said first direction, each said rod having a flange which is receivably engageable with said first or second groove in the bottom of said block member;

wherein the display switching unit has, mounted on opposite sides of said plane of arrangement of the display elements $D_{ij}$, an erasing magnetic head $E_j$ and a writing head $G_j$ common to the display elements $D_{1j}$ to $D_{Nj}$ disposed on the line of arrangement $b_j$, said erasing magnetic head $E_j$ and said writing magnetic head $G_j$ being spaced apart from one another in the second direction;

wherein the drive unit is provided with means for moving said display elements $D_{ij}$ and the erasing magnetic heads $E_j$ and the writing magnetic heads $G_j$ relative to each other in the second direction, and means for energizing the writing magnetic heads $G_j$ in synchronism with the relative movement between said writing magnetic heads $G_j$ and said display elements $D_{ij}$;

said erasing head $E_j$, when said second display surface lies in a predetermined plane, turning said display element $D_{ij}$ in synchronism with the relative movement of the display element $D_{ij}$ and the erasing head $E_j$ to locate said first display surface in said predetermined plane; and said writing head $G_j$, when energized, turning the display element $D_{ij}$ 90° to switch the state in which said first display surface lies in said predetermined plane to the state in which the second display surface lies in said predetermined plane.

* * * * *